US006718895B1

(12) United States Patent
Fortuna

(10) Patent No.: US 6,718,895 B1
(45) Date of Patent: Apr. 13, 2004

(54) METHOD FOR PRODUCING A RAISED APPLIQUE ON A SUBSTRATE AND ARTICLES MADE THEREFROM

(76) Inventor: Terrence M. Fortuna, 5297 Glenwood Creek, Clarkston, MI (US) 48348

( * ) Notice: Subject to any disclaimer, the term of this patent is extended or adjusted under 35 U.S.C. 154(b) by 0 days.

(21) Appl. No.: 10/231,743

(22) Filed: Aug. 30, 2002

Related U.S. Application Data

(60) Provisional application No. 60/316,176, filed on Aug. 30, 2001.

(51) Int. Cl.[7] ..... D05C 5/04
(52) U.S. Cl. ..... 112/475.19
(58) Field of Search ..... 112/475.19, 475.18, 112/475.08, 102.5, 470.07, 470.06, 475.04, 475.05, 439; 700/138

(56) References Cited

U.S. PATENT DOCUMENTS

| | | | | |
|---|---|---|---|---|
| 3,463,692 A | | 8/1969 | Brunner | |
| 4,103,634 A | | 8/1978 | Schachter | |
| 4,530,665 A | | 7/1985 | Colonel | |
| 5,005,219 A | | 4/1991 | Diaz | |
| 5,168,822 A | | 12/1992 | Nufer et al. | |
| 5,241,919 A | * | 9/1993 | LaGreca | 112/439 X |
| 5,438,520 A | * | 8/1995 | Satoh et al. | 700/138 X |
| 5,537,939 A | * | 7/1996 | Horton | 112/475.19 |
| 5,740,055 A | * | 4/1998 | Iwata | 112/475.19 X |
| 6,051,090 A | | 4/2000 | Healy et al. | |

* cited by examiner

*Primary Examiner*—Peter Nerbun
(74) *Attorney, Agent, or Firm*—Lynn E. Cargill

(57) ABSTRACT

A method for securing a raised appliqué to a substrate and the articles resulting therefrom. The preferred method includes various steps of digitizing an ornamental pattern into a computer format, then using that format to stitch, cut, and embroider an appliqué and wadding material onto a substrate, such that the appliqué is three dimensionally raised in portions by the wadding material, and the resulting combination of substrate, wadding material and appliqué material may then be sculpted out to form an attractive raised appliqué design suitable for use on any substrate, but especially garments, headwear and similar articles.

20 Claims, 3 Drawing Sheets

METHOD FOR PRODUCING A RAISED APPLIQUE ON A SUBSTRATE AND ARTICLES MADE THEREFROM

CROSS REFERENCES TO RELATED APPLICATIONS

This application claims the benefit of U.S. Provisional Application No. 60/316,176 filed on Aug. 30, 2001.

TECHNICAL FIELD

The present invention relates to methods for appliquéing designs and/or names onto fabric items, such as clothing and accessories, and more particularly relates to methods for producing raised appliqués on a substrate and articles therefrom.

BACKGROUND OF THE INVENTION

In the clothing and accessory industry, appliquéing sports team names, brand names, and personalization and the like has become popular. Hats, sweatshirts, jackets, and gym bags are just examples of the types of items that are embroidered with designs or names. Appliqués that are especially desirable are those that are aesthetic, high quality, durable, and unique.

Recently, the standards for desirable appliqué and embroidery on garments and other consumer goods have risen due to the advancement in the machine technology. As the embroidering machines have become more and more computer controlled, such that a consistent product is possible, the ornamental aspects of the embroidery have also advanced.

Sports promotions, corporate clothing, and other promotional goods are increasingly looking for more and more attractive decorations thereon. Even restaurants and theme parks are able to sell T-shirts, polo shirts, hats and the like, so long as their logos and brandings are prominently displayed on the clothing, etc. The current trend in the industry is that anything with a name or logo emblazoned on it will sell in great quantities. Entire stores have been set up just to sell licensed Disney goods, and sport-related paraphernalia, among others. The malls are replete with logo-based merchandise in the stores, and the logo-bearing articles are the big sellers.

Consequently, it has become more and more attractive for the adornment companies to have bigger and better means for decorating clothing and other articles. Embroidery is the method of choice, and is practiced more and more with the new machines. However, there is always room for improvement. As a matter of fact, there is a desire by consumers to have more complicated embroidery, with more colors and more artistic license.

Therefore, it would be an advantage to the industry to have an even more attractive means and method for embroidery even fancier logos and artistic designs onto a substrate, whether that substrate is a garment, a backpack, a hat, or any other desirable article.

SUMMARY OF THE INVENTION

In accordance with achieving the above-described advantage, the present invention includes a method for applying a fancy raised appliqué with a great deal of embroidery onto a substrate in a way that provides uniqueness, quality, aesthetics, and durability to the appliqué. The resulting appliqué is a three dimensional raised appliqué which is lifted up above the height of the fabric, yet has a smooth transition from the fabric to the appliqué. Satin stitching embroidery acts to hold down and secure the raised appliqué to the substrate, while it completely sculpts out the design and defines the perimeter of the design.

Generally, the desired artwork is made and the design is then digitized by any known means, such as computer scanning. Once the design is digitized, that information may be preferably transferred to a modern computer controlled stitching machine. Although, not absolutely necessary to practice the present invention, the present method preferably utilizes the digitized format and first outlines the placement of the appliqué on the desired substrate (such as a hat or jacket), preferably by stitching, but any other known means may be employed, such as printing on the substrate with a paint or other marking.

Then, the same digitized information may be used as a "cut file" on a computerized cutting machine to cut out the desired design. Then, a piece of polyfoam or other wadding material capable of raising the appliqué (hereinafter generically referred to as "polyfoam"), may either be first adhered to the substrate at the outlined location, or the polyfoam may be first adhered to a piece of the appliqué fabric in the approximate shape of the desired appliqué, and then both pieces put down together. It is best for the cutting procedure if the polyfoam is already adhered to the appliqué material prior to the cutting, so that steps are eliminated and they are both exactly the same shape.

Although the terms "appliqué fabric" or "appliqué material" may be used throughout this text, material other than fabric may be used, such as suede, leather, vinyl, and other heavy materials, even including plastic, so long as it can endure the appliqué method and final use of the item which has been appliquéd. After the appliqué fabric and polyfoam have been attached to the substrate, the appliqué fabric and polyfoam are preferably tacked down with stitches to facilitate the embroidery stitching thereafter. Then, the appliqué fabric piece is embroidered around the edges, overlapping the edge of the appliqué fabric piece. Additional embroidery may be added to either the appliqué or in the vicinity of the appliqué to produce the desired end result. The polyfoam raises up the appliqué, and the surrounding embroidery acts to sculpt the design, resulting in a very attractive decoration on the substrate.

DETAILED DESCRIPTION OF THE INVENTION

In accordance with the method and resultant article of the present invention, one of the preferred methods of appliquéing a raised design onto a fabric item is generally illustrated in FIGS. 1–6. The first step of the preferred method is to somehow delineate and outline the desired location for the desired design on the substrate, such as a garment, hat, backpack or other fabric item. One way of outlining the location and shape of the appliqué can be to sew an outline stitch in the likeness of the desired design with the use of a computer-aided sewing machine using CAD (computer aided design) or other computer equipment. Other methods may include stamping a paint thereon, or any other method known.

Figure 1:
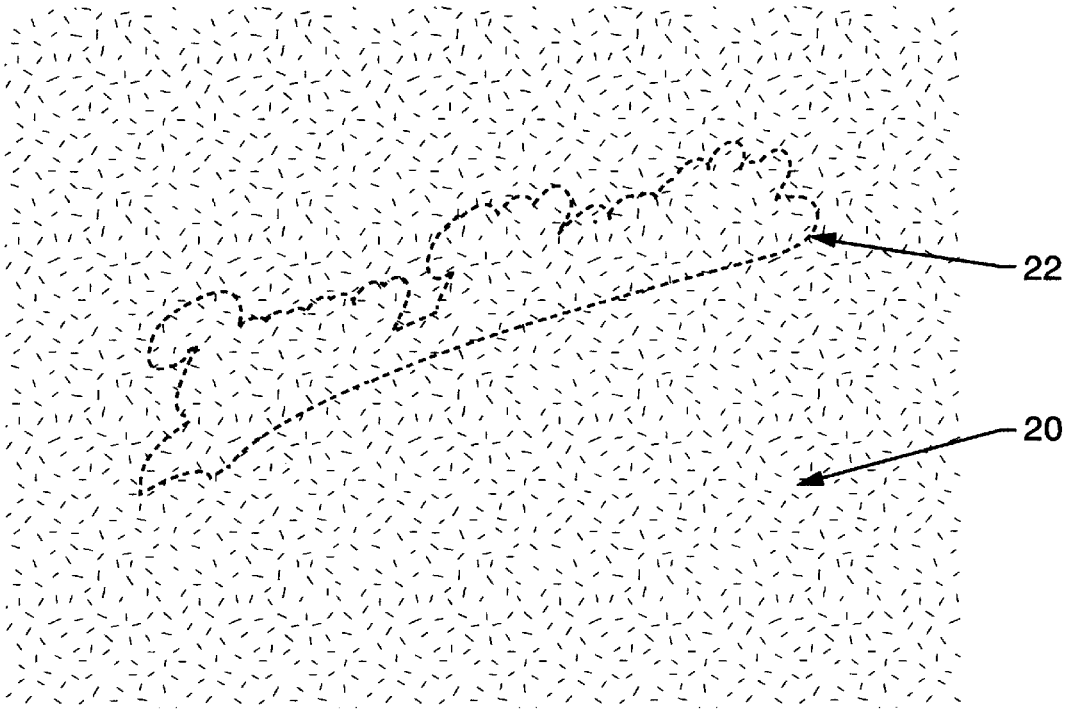
FIG. 1 illustrates the step of sewing an outline stitch on the desired location on the substrate.

Preferably, however, a computer attached to an embroidery machine will utilize the digitized format of the desired design to direct the embroidery machine to make an outline stitch in the desired pattern and location. To achieve this outline stitch, the desired design is preferably first digitized in a computer file that can follow the outer perimeter of the design. The computerized sewing machine preferably contains several unique stitches and paths which may be used in the method. Then, from the digitized file, the outline stitch may be generated and sewed onto the substrate or fabric item to designate the location and general shape of the design on the fabric item. To illustrate the step of outlining, FIG. 1 shows a substrate 20 with an outline stitch 22, representing the outer perimeter of the desired design.

For the next step, there are two possible methods for placing a piece of wadding or other means for raising the appliqué, such as polyfoam, under the appliqué material itself. First, the polyfoam may be in a small sheet the approximate shape of the desired design appliqué, and may be adhered to a similarly sized sheet of the appliqué material prior to cutting. Or, in the alternative, the other method may include individually cutting the polyfoam and the appliqué material to the desired shapes prior to adhering to the desired location on the substrate. In the first method, an approximately sized piece of appliqué fabric is adhered to a similarly sized sheet or piece of the wadding or polyfoam piece. Sheets of polyfoam are most preferred. The most preferred appliqué-raising foam is preferably made of a material composed of about 80% by weight of ethylene, vinyl, acetate and resin, about 3% by weight of blowing agent, about 0.5% to 1.0% by weight of crosslinking agent, about 1.5% by weight stearic acid, about 13% by weight calcium carbonate, and about 3% by weight pigment. The most preferred material is sold under the generic names of "3d Foam" or "Puff Foam", available commonly in the industry from a number of sources. The preferred polyfoam material is typically from about 0.5 to about 5 mm thick, preferably about 2 mm thick. The appliqué fabric may be essentially any type of fabric but is preferably a dense non-woven material, e.g., suede, leather or other dense materials that can stand up to wear and tear.

This invention may be accomplished in several ways. One preferred way is to perform several substeps, that is, (1) apply an adhesive to a sheet of the appliqué fabric or, in the alternative, an appliqué fabric with adhesive already thereon may be purchased, (2) attach a sheet of polyfoam material to the adhesive-coated appliqué fabric, whether pre-coated from the manufacturer or individually adhesive-coated by spraying at the time, (3) cut both pieces simultaneously to form a puffed up appliqué piece, (4) apply adhesive to the backside (the backside of the polyfoam side) of the combination appliqué/polyfoam piece, and (5) adhere the puffed up appliqué piece to the substrate with the appliqué fabric facing outwardly.

Although any suitable adhesive may be used for any of these steps, the preferred adhesive is sold under the trade name "MSA-1000", a spray adhesive available from the Madiera Company of the United Kingdom. It is preferred because it can be easily sprayed on, and it will not foul the sewing machine needles during the embroidery operation. The cutting of the polyfoam and appliqué fabric may be accomplished using a computer-aided cutting machine which is controlled by the digitized format which was generated for the outline. The preferred machine is one which can be computer controlled, such as an Ioline 300 blade cutting machine, available from Ioline Corp. of the United States. This machine is capable of cutting multiple pairs of the combined polyfoam/appliqué layers into a desired shape.

Figure 2:
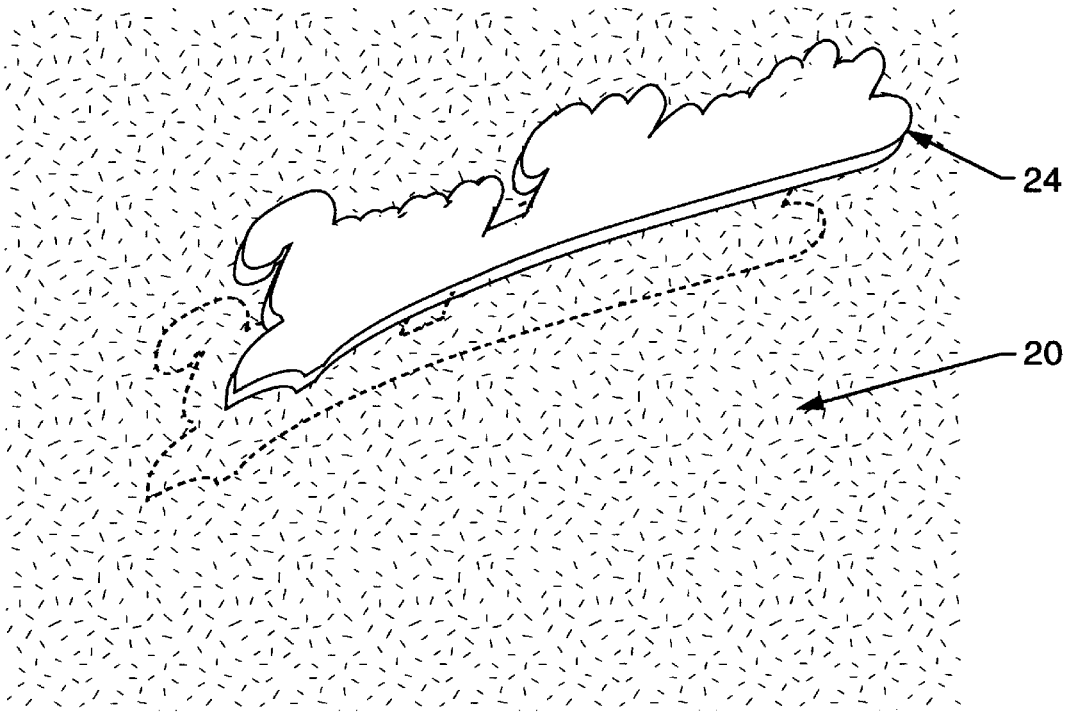
FIG. 2 illustrates the step of locating a cut piece of polyfoam over the outline stitch.
Figure 3:
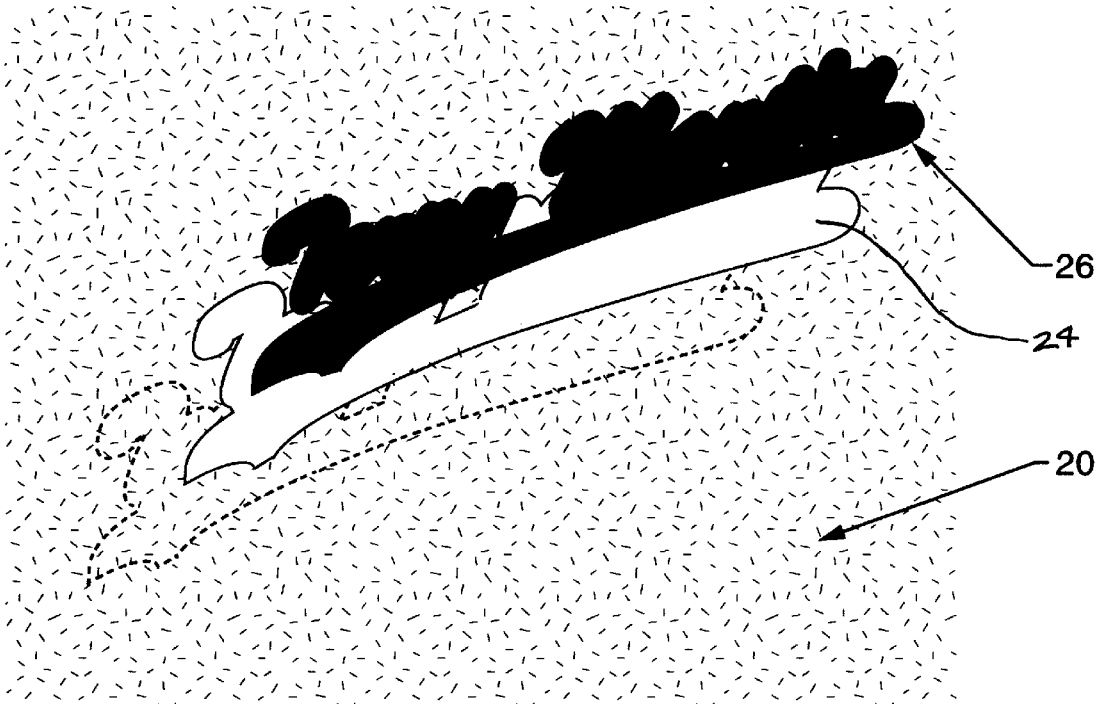
FIG. 3 illustrates the step of locating a cut piece of appliqué material over the cut polyfoam.

Other ways of performing this step may include altering the order of these substeps. Although FIGS. 2 and 3 represent one of the preferred methods, where FIG. 2 shows cut polyfoam piece 24 adhered to fabric item 20, and FIG. 3 shows cut appliqué piece 26 adhered to the top of polyfoam piece 24, the present invention contemplates any method of digitizing the cutting and sewing of a puffed up appliqué on a substrate. The most preferred method adheres an approximately shaped small sheet of the appliqué material onto a similarly sized sheet of the polyfoam, followed by cutting both together to the desired size and shape.

In the next general step, the adhered appliquéd piece is preferably stitched in place within the outline stitch via tack stitches, known as tack stitching, to hold it in place, although adhesives, hoops, clips or even gravity itself may also be used to hold the combination polyfoam/appliqué piece in place for later embroidery work. Preferably, the cut-out combined polyfoam/appliqué shape is slightly smaller than the outline stitch, and is somewhat held in place within the outline stitch by the raised threads. After the appliqué piece is in place, tack stitching may hold it in place. The computer controlled embroidery machine can be directed to stitch the tack stitching in a precise pattern within the boundaries of the appliqué piece, yet close enough to the edge to be covered by the satin stitch or embroidery sculpting out stitch, to follow.

Figure 4:
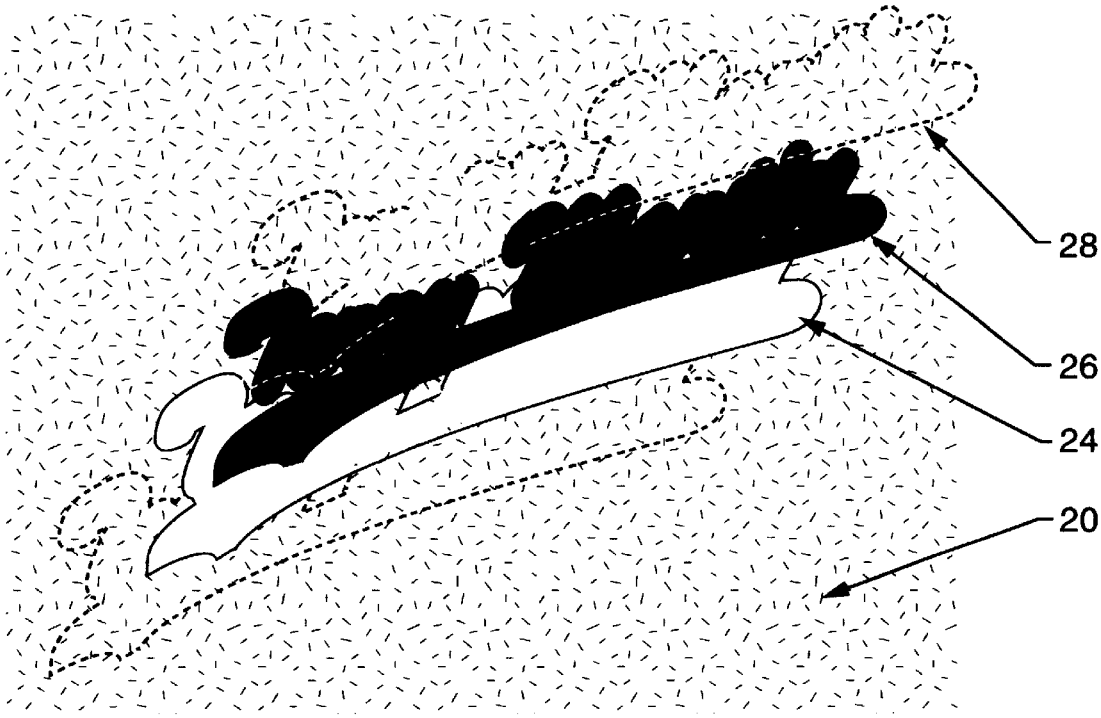
FIG. 4 illustrates the step of sewing a tack down stitching to hold the polyfoam and the appliqué for later procedures.

As discussed above, this step of tack stitching may be performed by a computer-aided embroidery machine with the result being shown in FIG. 4 illustrating tack down stitching 28 around the perimeter of the appliqué piece 26. The tack stitching is preferably from about 0.1 mm to about one (1) millimeter within the perimeter, so that the satin stitching procedure described hereinbelow will cover the tack stitching when completed.

Figure 5:
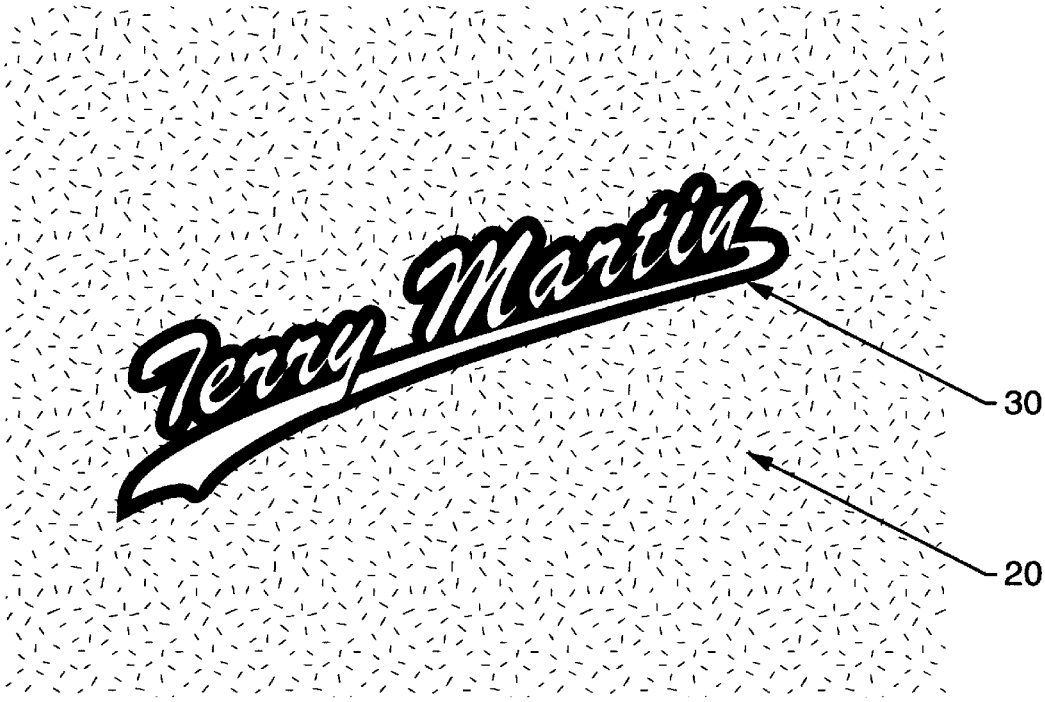
FIG. 5 illustrates the step of embroidering around the design, allowing for the appliqué to be raised up and sculpted out.

Next, the stitched-in-place appliqué is embroidered around the entire design with a wide, closely packed zig-zag stitch, preferably a satin stitch. The satin stitch may be of any width from about 1.0 to about 20 millimeters, but is preferably from about 2 to 5 millimeters wide. The actual thickness of the stitch depends on the choice of the thread itself. If the thread is a light polyester, then the thickness will be slight, while the thickness will be on the order of from about 1 to about 10 millimeters thick if a thick, shiny thread is utilized. FIG. 5 shows embroidery satin stitch 30 which covers the edge of the appliqué item, and extends inwardly into the interior of the raised appliqué design far enough to cover the tack stitching, thereby covering it up. Typically, the embroidery is from 1 to 20 mm wide, but preferably is about 4–5 mm wide. It is also preferred to embroider to the extent that none of the appliqué edge can be seen. The embroidering may be done with any type of thread but 30 weight thread is preferred, which is thicker and more denser than standard 40 weight embroidery thread. Rayon or polyester threads are the preferred types of thread, as they are strong and highlight the embroidery from the remainder of the appliqué. The overall result of the appliqué is a raised appliqué (due to the polyfoam thereunder) which rises smoothly from the surface of the fabric item to the top of the appliqué. This produces an appliqué which is sculpted out.

Figure 6:
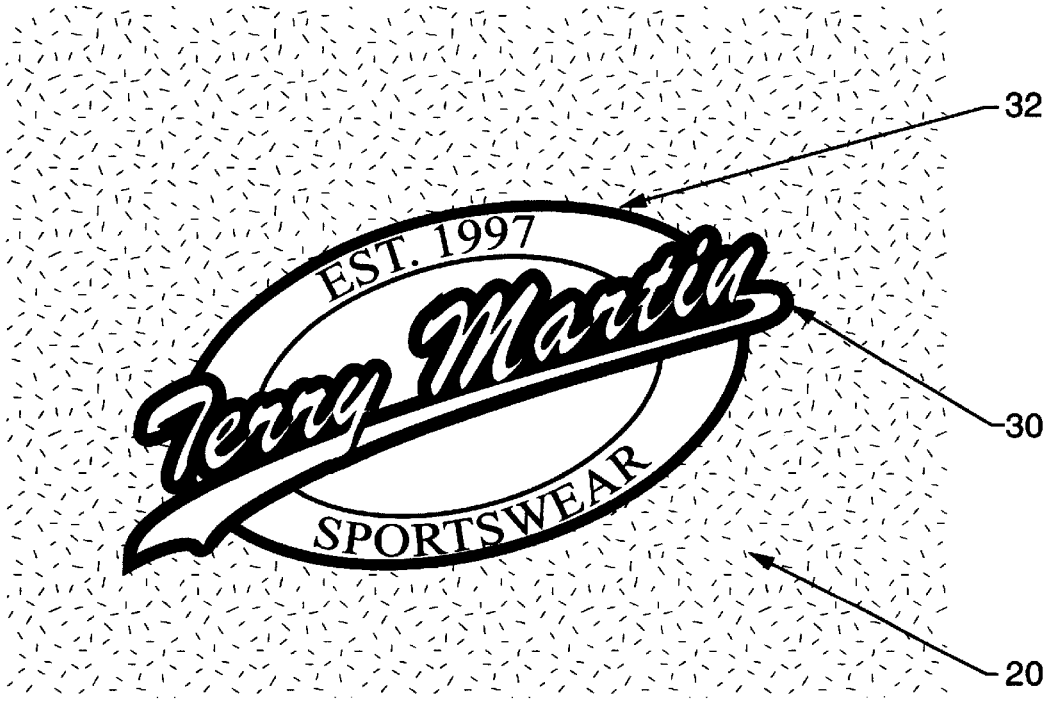
FIG. 6 illustrates the final embroidery to finalize the design.

Optionally, other embroidery may be added, to either another part of the appliqué or in the vicinity of the appliqué. This additional embroidery will act to sculpt out little "pockets" of the raised appliqué, so that various levels of heights may be achieved within the same design. FIG. 6 shows the finished appliqué with additional embroidery 32. Other direct embroidery can then be done to complete the design. Thread colors and specific types of appliqué material will vary depending upon the design and availability.

Therefore, the present invention provides an attractive raised appliqué, and a method for making same, that can be consistently made with the aid of computer-directed sewing and/or embroidery machines. This process is especially useful in the application of logos and artwork to headwear, outerwear, shirts, luggage, backpacks, handbags, scarves and the like. Of course, this technology is applicable to any fabric or article of manufacture, and shall not be limited by the disclosure herein, but rather only by the limits set by the appended claims.

What is claimed is:

1. A method of forming and securing a shaped appliqué to a substrate, comprising:

digitally formatting an ornamental pattern for a desired appliqué;

utilizing the digitalized format to control a computer-directed embroidery machine to sew an outline stitch which follows the outside perimeter of an appliqué having certain outer dimensions;

digitally transmitting the digitized format to a cut file, whereby a computer directed cutting machine can digitally cut pieces;

cutting the desired appliqué using the cut file to form an appliqué with both front and back sides;

applying an adhesive to the back side of the appliqué to form a tacky surface;

adhering the tacky backside of the appliqué to a pre-shaped appliqué raising and padding material having a thickness of from about 0.5 mm to about 10 mm, said pre-shaped appliqué raising and padding material being of a length and width which approximates the outer dimensions of the cut appliqué itself, thereby forming a three dimensionally raised padded appliqué in the desired shape;

holding the padded appliqué in place on the substrate with a tack down stitch, awaiting further stitching; and satin stitching around the outer dimension of the padded appliqué, whereby the desired design is sculpted out, giving the appliqué a raised look.

2. The method of claim 1, wherein the step of cutting the desired appliqué is accomplished by cutting appliqués selected from the group consisting of suede, leather, vinyl, plastic and other heavy materials.

3. The method of claim 1, wherein said step of adhering the tacky backside of the appliqué to a pre-shaped appliqué raising and padding material is accomplished by utilizing appliqué materials selected from the group consisting of polyfoam, foamed materials, and wadding.

4. The method of claim 3, wherein said polyfoam is preferably made of a material composed of about 80% by weight of ethylene, vinyl, acetate and resin, about 3% by weight of blowing agent, about 0.5% to 1.0% by weight of crosslinking agent, about 1.5% by weight stearic acid, about 13% by weight calcium carbonate, and about 3% by weight pigment.

5. The method of claim 3, wherein said polyfoam is from about 0.5 mm to about 5 mm thick.

6. The method of claim 1, wherein the step of adhering the tacky backside of the appliqué is accomplished by utilizing a spray adhesive capable of not fouling the computer-directed embroidery machine during sewing.

7. The method of claim 1, wherein the step of digitally cutting the appliqué pieces is accomplished by using a blade cutting machine.

8. The method of claim 1, wherein steps of cutting the desired appliqué and the appliqué raising and padding material are done together.

9. The method of claim 1, wherein the step of holding the padded appliqué with a tack-down stitch is accomplished by utilizing a tack-down stitch from about 0.1 mm to about 1 mm within the perimeter of the appliqué.

10. The method of claim 1, wherein the step of satin stitching is accomplished by satin stitching from about 2 mm to about 5 mm wide.

11. A method of forming and securing a shaped appliqué to a substrate, comprising:

digitally formatting an ornamental pattern for a desired appliqué;

utilizing the digitalized format to control a computer-directed embroidery machine to sew an outline stitch which follows the outside perimeter of an appliqué having certain outer dimensions;

digitally transmitting the digitized format to a cut file, whereby a computer directed cutting machine can digitally cut pieces;

cutting the desired appliqué using the cut file to form an appliqué with both front and back sides;

applying an adhesive to the back side of the appliqué to form a tacky surface;

adhering the tacky backside of the appliqué to a pre-shaped appliqué raising and padding material having a thickness of from about 0.5 mm to about 10 mm, said pre-shaped appliqué raising and padding material being of a length and width which approximates the outer dimensions of the cut appliqué itself, thereby forming a three dimensionally raised padded appliqué in the desired shape;

holding the padded appliqué in place on the substrate with a tack down stitch, awaiting further stitching;

satin stitching around the outer dimension of the padded appliqué, whereby the desired design is sculpted out, giving the appliqué a raised look; and embroidering additional embroidery to sculpt out pockets of the raised appliqué, such that various levels of height may be achieved within the same design.

12. The method of claim 11, wherein the step of cutting the desired appliqué is accomplished by cutting appliqués selected from the group consisting of suede, leather, vinyl, plastic and other heavy materials.

13. The method of claim 11, wherein said step of adhering the tacky backside of the appliqué to a pre-shaped appliqué raising and padding material is accomplished by utilizing appliqué materials selected from the group consisting of polyfoam, foamed materials, and wadding.

14. The method of claim 13, wherein said polyfoam is preferably made of a material composed of about 80% by weight of ethylene, vinyl, acetate and resin, about 3% by weight of blowing agent, about 0.5% to 1.0% by weight of crosslinking agent, about 1.5% by weight stearic acid, about 13% by weight calcium carbonate, and about 3% by weight pigment.

15. The method of claim 13, wherein said polyfoam is from about 0.5 mm to about 5 mm thick.

16. The method of claim 11, wherein the step of adhering the tacky backside of the appliqué is accomplished by utilizing a spray adhesive capable of not fouling the computer-directed embroidery machine during sewing.

17. The method of claim 11, wherein the step of digitally cutting the appliqué pieces is accomplished by using a blade cutting machine.

18. The method of claim 11, wherein steps of cutting the desired appliqué and the appliqué raising and padding material are done together.

19. The method of claim 11, wherein the step of holding the padded appliqué with a tack-down stitch is accomplished by utilizing a tack-down stitch from about 0.1 mm to about 1 mm within the perimeter of the appliqué.

20. The method of claim 11, wherein the step of satin stitching is accomplished by satin stitching from about 2 mm to about 5 mm wide.

* * * * *